US007594472B1

(12) United States Patent
Parratt et al.

(10) Patent No.: US 7,594,472 B1
(45) Date of Patent: Sep. 29, 2009

(54) SABOT

(75) Inventors: Noel J. Parratt, Iqtham (GB); John Cook, Cheshunt (GB); Nicholas Savage, Bramfield (GB); Michael J. Hinton, Maidstone (GB)

(73) Assignee: QinetiQ Limited, London (GB)

( * ) Notice: Subject to any disclaimer, the term of this patent is extended or adjusted under 35 U.S.C. 154(b) by 0 days.

(21) Appl. No.: 07/544,142

(22) Filed: Jun. 13, 1990

(51) Int. Cl.
*F42B 14/06* (2006.01)

(52) U.S. Cl. ..... 102/520; 102/521; 102/522; 102/523

(58) Field of Classification Search ..... 102/520, 102/521, 522, 523, 703
See application file for complete search history.

(56) References Cited

U.S. PATENT DOCUMENTS

| | | | | | |
|---|---|---|---|---|---|
| 4,542,696 | A | * | 9/1985 | Bisping et al. | 102/523 |
| 4,651,649 | A | * | 3/1987 | Nussbaum | 102/521 |
| 4,953,466 | A | * | 9/1990 | von Gerlach | 102/521 |
| 4,958,571 | A | * | 9/1990 | Puckett | 102/522 |

FOREIGN PATENT DOCUMENTS

| | | | |
|---|---|---|---|
| EP | 0 258 647 | 3/1988 | |
| EP | 0 355 265 | 2/1990 | |
| GB | 2227817 | * 8/1990 | 102/520 |
| WO | WO 87/05386 | 9/1987 | |

OTHER PUBLICATIONS

French Search Report dated Nov. 27, 2008 for French Application 9014997.

R. Bletsis, "Development of Composite Sabots for High Aspect Ratio Subcaliber Projectiles" 28th National SAMPE Symposium, Apr. 1983, pp. 1107-1115.

B.P. Burns et al, "Structural Design of Projectiles" Proc. 9th Int. Symposium on Ballistics (Part 1), Apr. 1986, pp. 1-265 to 1-274.

* cited by examiner

*Primary Examiner*—James S Bergin
(74) *Attorney, Agent, or Firm*—Nixon & Vanderhye P.C.

(57) ABSTRACT

A sabot 7 having a rearward end and a central longitudinal channel 1 which is engageable with projectile 33 has an anisotropic compressive strength distribution such that on individual radial planes the compressive strength in a first principal material direction $P_1$ radiates from the central channel 1 towards the rearward end of the sabot. This permits a more even distribution of force at the interface between the sabot and the penetrator.

The sabot may be constructed from a fibre reinforced plastic composite, containing a single or a double array of fibres.

19 Claims, 6 Drawing Sheets

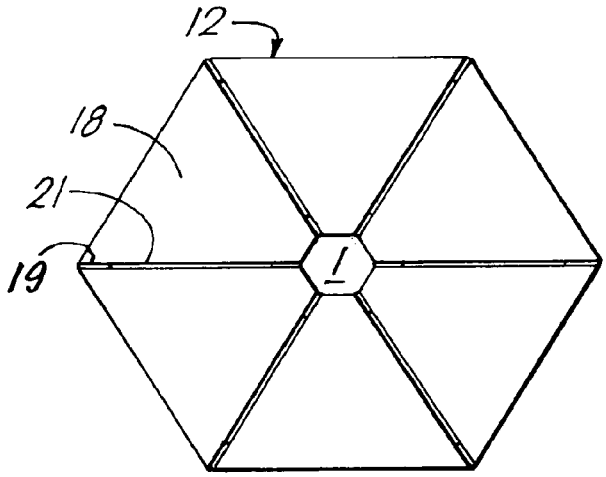
Fig.8a.
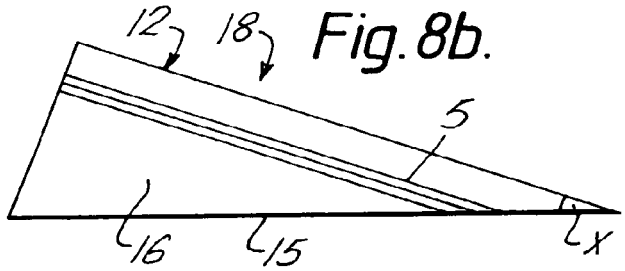
Fig.8b.
Fig.8c.
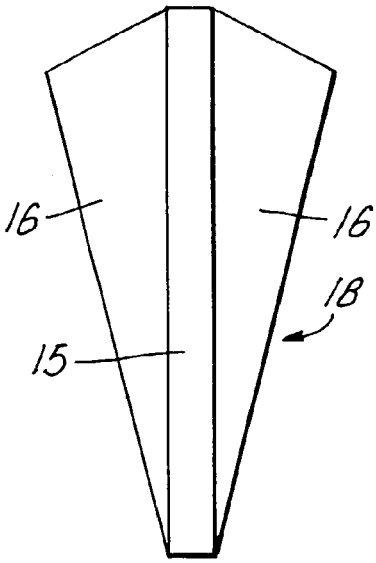
Fig.9.
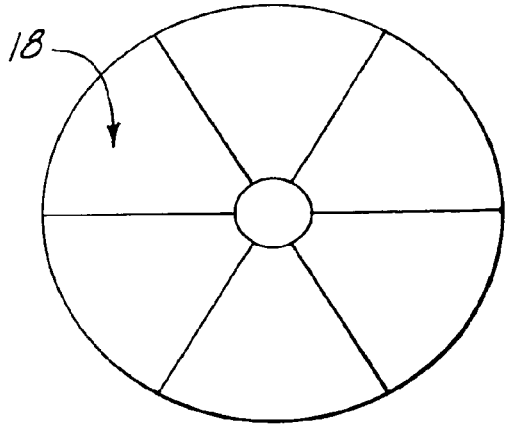

SABOT

The invention relates to the field of sabots used in the launching of long rod kinetic energy penetrators.

When sub-calibre long rod penetrators are to be projected from a gun barrel a sabot is used which acts to support the rod in the barrel and transfer the force of the propelling gas to the rod. The transfer of force is normally achieved by a threaded interface between the rod and the sabot which extends over a substantial portion of the rod length. Sabots are conventionally made from a number of segment shaped "petals" which are held around and engage a screw thread on the rod. The sabot is provided with a forwardly directed air scoop which acts both to support the rod in the barrel and strip the petals aerodynamically from the rod once it has left the barrel. The sabot is typically made from an isotropic body of high strength aluminium alloy the mass of which is usually similar to that of the rod being projected for large diameter barrels, although polymeric sabots for small ammunition rounds are also known.

In addition to its overall strength two very important factors in the design of the sabot are (a) the mass of the sabot and (b) the way in which the sabot distributes the propelling force to the rod.

The mass of the sabot is important because it represents a parasitic load, the kinetic energy of which is lost when the sabot is discarded. A reduction in sabot mass will thus increase the rod's barrel exit velocity and reduce the mechanical interaction with the rod during sabot discard. Alternatively it may enable the calibre of the gun to be reduced for the same rod diameter and muzzle exit velocity giving considerable logistic advantages in the field.

The scope for significantly reducing the volume of sabot material from current levels using aluminium alloy is limited, due to design considerations such as maximum permissible length of unsupported rod and the length of the sabot-rod engagement.

The distribution of the propelling force along the rod is of great importance because two common limiting failure modes of sabot rod assemblies are snapping of the rod in tension and stripping of the threaded interface between the sabot and the rod during rod acceleration in the barrel. The premature stripping of the sabot from the rod normally takes place in a progressive manner starting from the rear end of the sabot where the load transfer between the sabot and the rod is at its highest.

To a limited extent the distribution of shear stress along the sabot-rod interface can be controlled by the configuration of sabot used, there being two basic designs in common use which are shown schematically in FIGS. 1 and 2. These are:

(a) Single ramp saddle back sabot (FIG. 1). The propelling gas acts on a rearmost piston section of the sabot which is approximately perpendicular to the sabot axis. With this arrangement there is a tendency for load to be transferred to the rod over a length of the order of a bore diameter at the rear end of the sabot, leaving the forward part relatively redundant. This makes the single ramp saddleback sabot only suitable for relatively low rod accelerations or for projecting relatively low L/D (length/diameter ratio) rods.

(b) Double ramp sabot (FIG. 2). The propelling gas acts on a rearwardly facing acutely sloping pressure ramp which distributes part of the load over the part of the rod enclosed by the pressure ramp more evenly than the saddle-back sabot. A forwardly directed ramp spreads the remainder of the load slightly further forward.

A potential design for a sabot has been suggested in the past (Development of Composite Sabots for High Aspect Ratio Subcalibre Projectiles, 28th National SAMPE Symposium, April 1983, R Bletsis) which addresses the sabot mass and the sabot penetrator interface stress distribution problems. The sabot comprises triaxially oriented fibre laminae embedded in a matrix in which equal amounts of the fibres are arranged to run parallel to the central axis of the sabot and at both +450 and −45° to this direction thereby instilling axial and radial shear and compressive strength to the sabot, the aim and the result being to produce an almost isotropic sabot. The penetrator is provided with annular ridges with thrust faces perpendicular to the penetrator axis and the corresponding part of the sabot is provided with annular grooves of varying axial extent. In order to distribute the propelling force along the sabot-penetrator interface the grooves near the front end of the sabot are a closer fit on the ridges and those further back are progressively longer in axial extent than their associated ridges on the penetrator, thus allowing relative axial slip to take place between the sabot and the penetrator. This arrangement would clearly be very difficult to manufacture in the light of the varying size of grooves and the fact that the penetrator has to be a sliding fit in the sabot. Moreover only a minority of the fibres in the sabot can be used to resist the principal stress.

The inventors have recognised that the use of isotropic materials for the production of saddle back sabots and the front ramps of double ramp sabots is a very inefficient use of the material due to the fact that they only requires high compressive strength in one direction, namely that converging towards the penetrator, compressive strength in other directions being relatively redundant. They have now found that lightweight anisotropic sabots manufactured from commonly available raw materials can be made strong enough to withstand the high compressive loads applied to sabots. Moreover they have found that this is achievable without fibres which give the sabot compressive strength in unnecessary directions and thereby adding extra parasitic mass to the sabot penetrator combination.

Accordingly it is the object of the invention to provide an easily manufactured lightweight sabot which makes efficient use of certain structural materials which have a high compressive strength in one direction only by exploiting their anisotropy.

Thus according to the invention there is provided a sabot having a rearward end and a central longitudinal channel which is engageable with a projectile locatable therein, the sabot being made of a material having an anisotropic compressive strength distribution such that in individual radial planes which radiate outwards from the channel the sabot's maximum value of compressive strength is oriented in a first principal material direction and the sabot's minimum value of compressive strength is oriented in a second principal material direction, the material being oriented such that within individual radial planes the first principal material direction radiates from the channel towards the rearward end of the sabot.

The invention allows lightweight sabots to be easily made from a fibre reinforced composite the density of which may be approximately 1600 $Kg/m^3$ which provides a significant weight saving over conventional aluminium alloy sabots the density of which is usually approximately 2800 $Kg/m^3$.

The inventors have further recognised that the reason why the propelling force imparted to the rod by a conventional saddle back sabot takes place predominantly over a length of the order of a rod diameter at the rear end of the sabot, is that the shear stiffness of a conventional sabot is too high. By changing the shear modulus in the radial planes the distribution of shear stress at the sabot penetrator interface can be evened out resulting in (a) lower localised tensile and compressive stresses occurring in the penetrator and (b) a lower maximum shear stress at the sabot penetrator interface.

The shear modulus G, Young's modulus Y and Poisson's ratio U of a material are related by the expression:

$$E/G=2(1+U)$$

for isotropic materials (in which U lies in the range 0-0.5)

For the above reasons, within a given radial plane the value of compressive Young's modulus in the first principal material direction divided by the shear modulus measured in that plane taken along the first principal material direction is preferably greater than 3.

With currently available fibre and matrix materials there is a wide range of possible E/G values, and the analyses have shown that the value of E/G is of great importance. If E/G is too high the fibre alignment becomes very critical and manufacturing problems would occur. The optimum value of E/G is not however an absolute value but depends on the dimensions and proportions of the sabot concerned.

In order to reduce the tendency of the sabot to become prematurely stripped from the projectile, the sabot's channel is preferably provided with grooves with forwardly facing thrust transfer surfaces for engagement with the projectile and rearwardly facing return faces.

Conveniently the anisotropic compressive strength distribution is brought about by the sabot comprising a matrix containing a first array of substantially unidirectional fibres which radiate outwards at an acute angle to the channel towards the rearward end of the sabot.

A second array of substantially unidirectional fibres may be incorporated into the sabot which are substantially parallel to the sabot's central longitudinal channel. The advantages of incorporating these second array fibres are; (a) sculpting of the sabot in order to lighten it or form grooves on its inner surface is facilitated, (b) a rearward ramp may be made light and slender yet also able to support tension which may occur particularly when high gun pressures are employed, and (c) for a given principal material direction orientation the first array fibres may be orientated to converge less acutely with the sabot's central longitudinal channel, which will increase the thread frequency and thus reduce the stress on individual threads. (This is demonstrated diagrammatically in FIGS. 3 and 4 showing single and double array sabots respectively in both of which the principal material direction $P_1$ is orientated at an acute angle X to the sabot's central channel.)

In order that the first array fibres in the sabot are loaded axially, the thrust transfer surfaces preferably lie substantially perpendicularly in the path of the first array fibres.

To ensure that the first array fibres run in an undisturbed manner towards the thrust transfer surfaces the return faces are preferably disposed at substantially the same acute angle to the channel as the first array fibres.

The thrust transfer face and the return face of each groove preferably meet at an acute angle of between 70° and 90°. This results in increasing the thrust face area and permitting more ridges to be used for a given length of penetrator both of which reduce the tendency of the sabot to jump ridges or become completely prematurely stripped from the penetrator.

The sabot of the invention will now be described by way of example only with reference to the accompanying drawings in which:—

Figure 3:
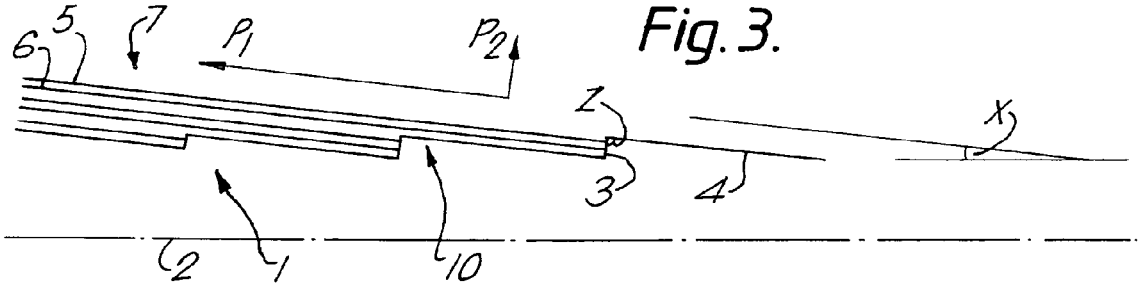
Figure 4:
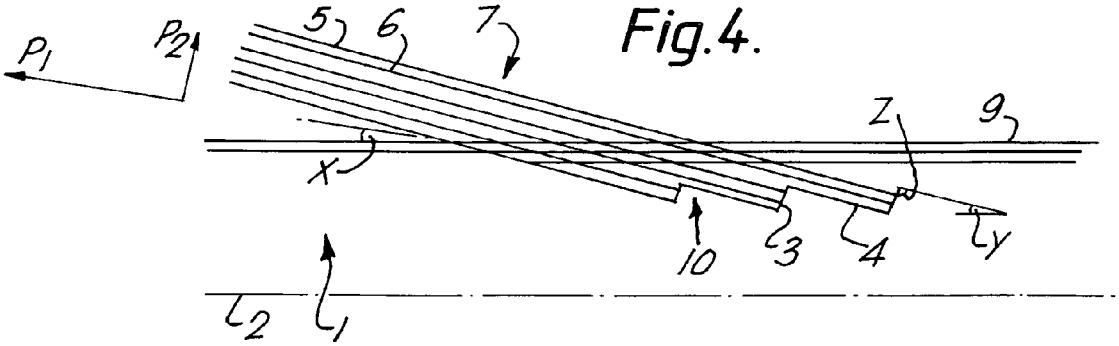
Figure 5:
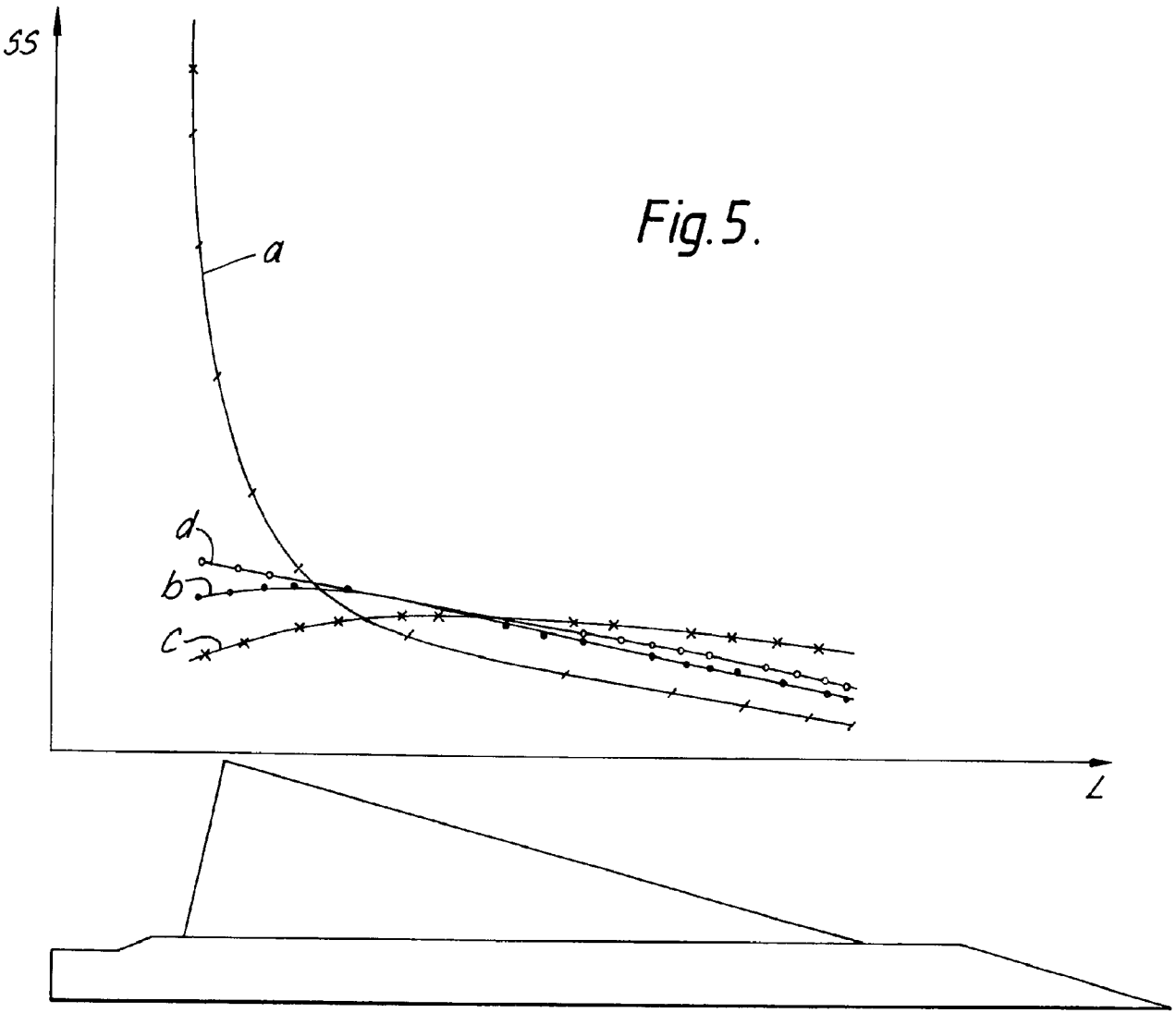
Figure 6:
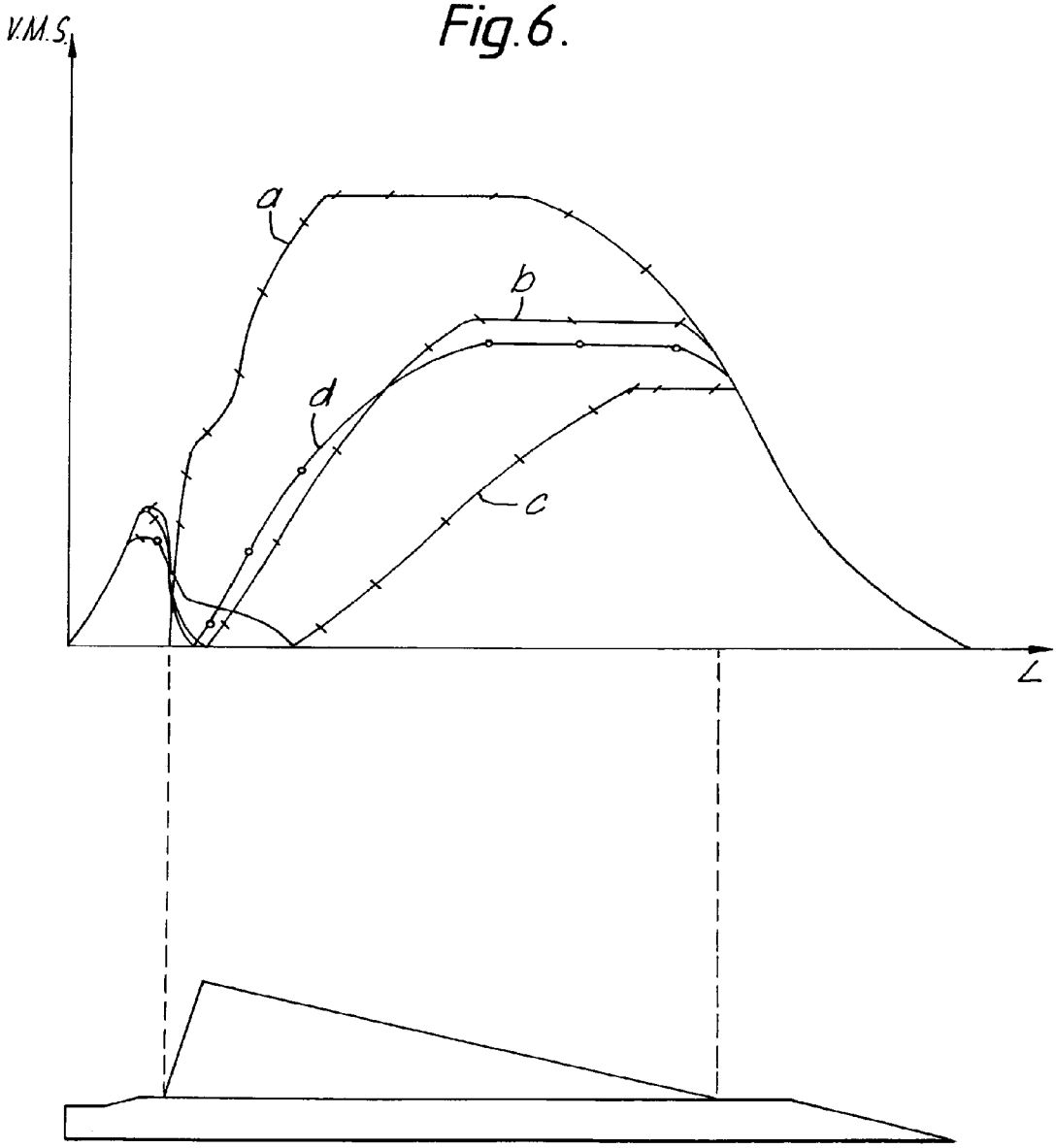

FIG. 3 is a schematic part cross sectional view on a radial plane of a sabot containing a single array of fibres FIG. 4 is a similar view to FIG. 3 of a sabot containing a first and a second array of fibres FIG. 5 is a graph showing sabot/penertator interface shear stress plots for identical penetrators being accelerated at the same rate by identically dimensioned sabots of various anisotropies FIG. 6 is a graph showing overall Von Mises stress plots along the centre lines of the identical penetrators being accelerated by sabots of various anisotropies described with reference to FIG. 5

Figure 7A:
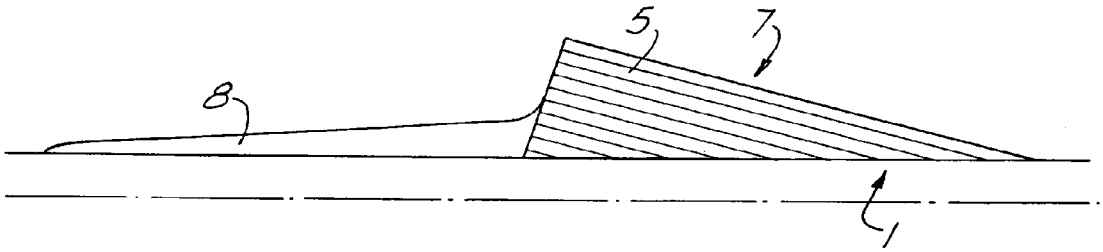
Figure 7B:
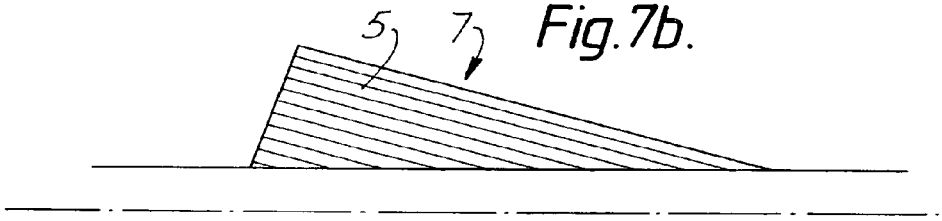

FIGS. 7*a* and 7*b* are schematic longitudinal cross sections through a double ramp and a saddle back sabot respectively showing the orientation of a single array of fibres FIG. 8*a* is a rear end elevation of 6 sector shaped petals ready for glueing together to form a sabot FIG. 8*b* is a side elevation of one of the petals shown in FIG. 8*a*

Figure 10:
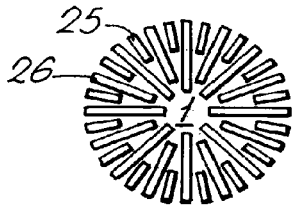
Figure 11:
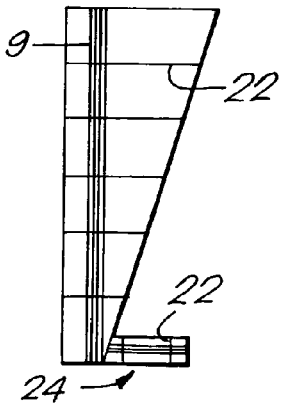
Figure 12:
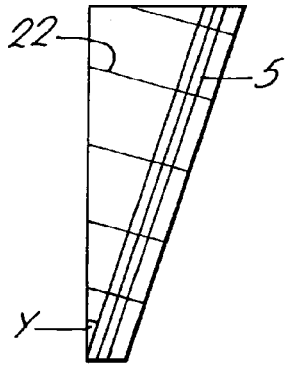

FIG. 8*c* is a plan view of the petal of FIG. 8*b* viewed from the sabot's central channel FIG. 9 is a rear end elevation of the sabot shown in FIG. 8*a* after glueing and machining FIG. 10 is a schematic rear end elevation of a sabot fabricated from radial laminations FIGS. 11 and 12 show the directions of the fibres and the shape of the laminations used in the sabot shown in FIG. 10

Figure 13:
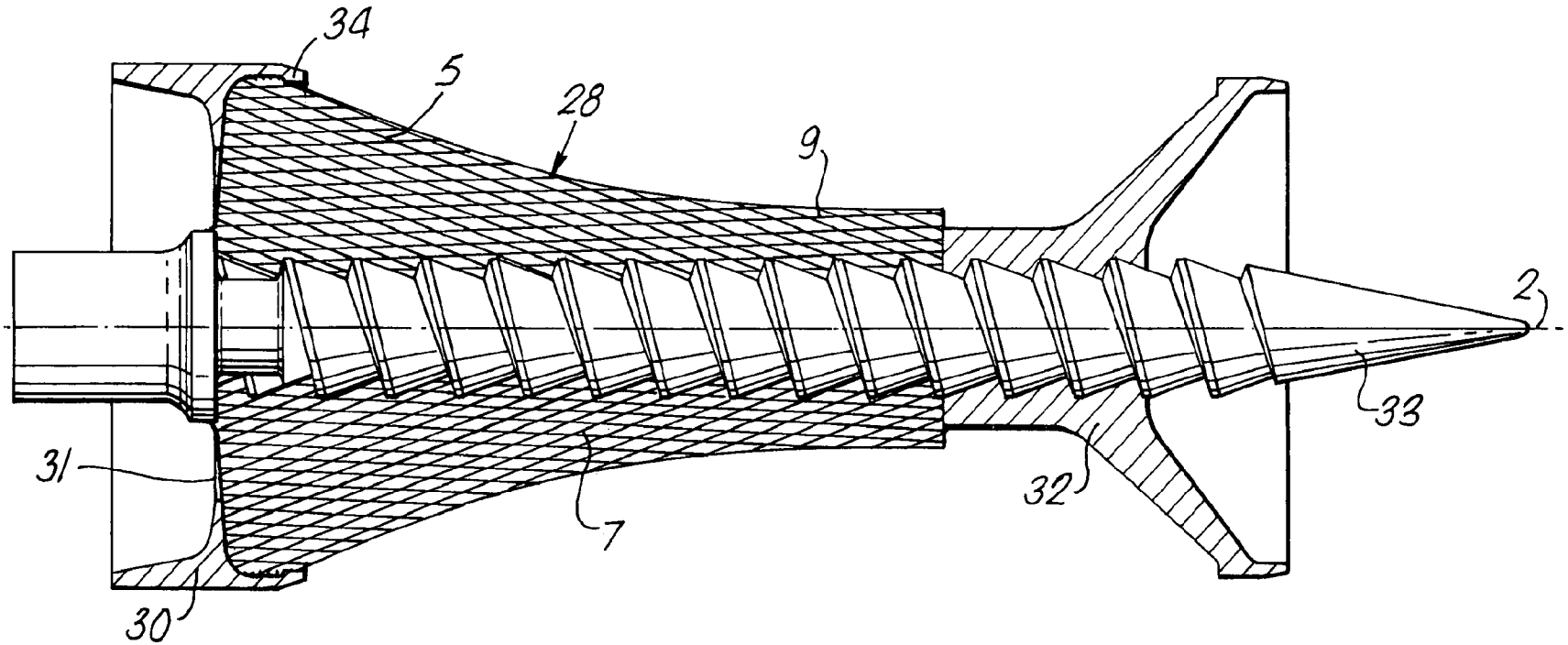

FIG. 13 shows a sectional view of a sub scale demonstration sabot according to the invention, in combination with a sectioned air scoop and obturating seal, and a penetrator.

Figure 1:
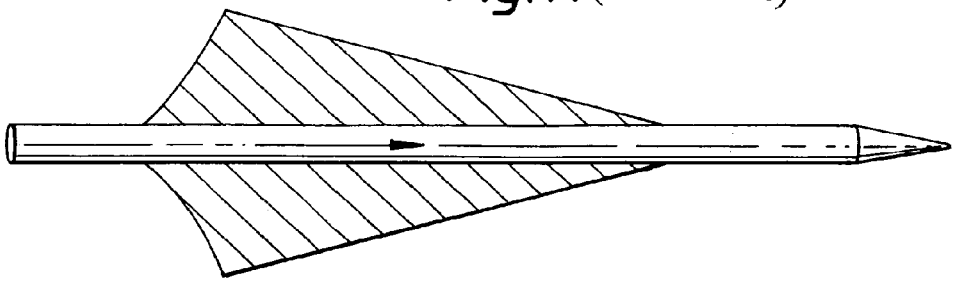
Fig. 1. (Prior Art)
FIG. 1 is a schematic cross section of a conventional saddle back sabot
Figure 2:
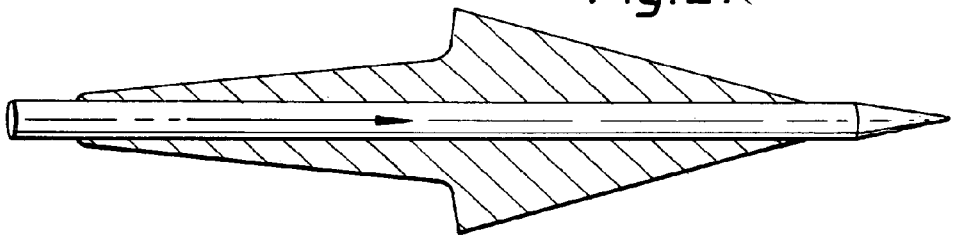
Fig. 2. (Prior Art)
FIG. 2 is a schematic cross section of a conventional double ramp sabot

FIGS. 1 and 2 are schematic cross sections of the two main types of sabot in common use today, the disadvantages of which have been discussed above. The intention is that while the internal make-up of the sabot of the invention will differ from those currently in use (commonly an isotropic mass of an aluminium alloy) the external form will be similar to one of the sabot types shown in FIGS. 1 and 2, which are respectively referred to as saddle back sabots and double ramp sabots.

The graphs shown in FIGS. 5 and 6 each have four plots marked (a) to (d) which represent the four different sabots described below;

(Anisotropy=Maximum Young's Modulus/Minimum Young's Modulus)

(E/G=Maximum Young's Modulus/Shear modulus in a radial plane)

(SL=Compressive Strength in First Principal Material Direction)

(SR=Compressive strength in second principal material direction)

a) conventional isotropic aluminium alloy sabot. (anisotropy=1, E/G=2.66, SL=SR=550 MPa)

(sabots (b), (c) and (d) are all carbon fibre reinforced plastic sabots in which the fibre occupies 60% of the total volume of the sabot) (b) CFRP sabot of medium strength fibres (Courtauld's XAS) oriented to lie at 10° to the sabot's longitudinal channel with an average strength resin matrix (Ciba-Geigy MY750). The fibres are arranged as shown in FIG. 3, with X=10° (anisotropy=14.5, E/G=28.8, SL=1200 MPa, SR=140 MPa)

(c) CFRP sabot of high modulus fibre (Toray M50) oriented to lie at 10° to the sabot's longitudinal channel, with a low modulus resin (Ciba-Geigy MY750 with a mono epoxy group diluent). The fibres are arranged as shown in FIG. 3, with X=10° (anisotropy=61.5, E/G=123.6, SL=800 MPa, SR=100 MPa)

(d) CFRP sabot of medium strength fibre (Courtauld's XAS), crossply laminates oriented so that the fibres are arranged as shown in FIG. 4, with X=10° and Y=20°, with an average strength resin matrix (Ciba-Geigy MY750) (anisotropy=13.3, E/G=14.73, SL=1100 MPa, SR=140 MPa)

FIG. 5 shows four plots of sabot/penetrator interface shear stress (SS) as a function of distance from the rear end of the penetrator (L) for identical penetrators being accelerated at the same rate by four identically dimensioned sabots constituted as described above. The plots clearly show how the maximum interface shear stress at the rear end of the sabot is significantly reduced by the use of an isotropic sabot (plots b, c and d) when compared with an isotropic sabot (plot a).

FIG. 6 shows four plots of overall Von Mises stress (VMS) on the penetrators' centre lines as a function of distance from the rear end of the penetrator (L), the penetrators being accelerated by the sabots described above. The result of using an anisotropic sabot (plots b,c and d) as opposed to an isotropic sabot (plot a) is that the maximum Von Mises stress is greatly reduced and shifted forward, showing clearly how more of the forward part of the sabot is 'working', spreading part of the propelling force further forward.

As mentioned above a very high value of E/G (as in case (c) anisotropy=61.5, E/G=123.6) is not the best solution in practical terms as the fibre orientation becomes very critical and not practically obtainable.

FIG. 3 is a schematic part cross-sectional view on a radial plane of a sabot 7 according to the invention, containing a first array of fibres 5 with a central longitudinal channel 1 having a central axis 2. Due to the orientation of the first array fibres 5 in the plane shown in FIG. 3 the sabot material in this plane will have a first principal material direction $P_1$ which is parallel to the direction of first array fibres 5 (in which the compressive strength is a maximum).

The direction of $P_1$ radiates from the channel 1 outwards towards the rear end of the sabot at an angle X, which lies in the range 6° to 35°. The compressive strength will be a minimum in the direction of the second principal material direction $P_2$ which is perpendicular to the direction of $P_1$.

The sabot is provided with grooves 10 each comprising a forwardly facing thrust transfer surface 3 and a rearwardly facing return face 4. These grooves 10 may be annular or constitute a continuous screw thread. Each return face 4 is parallel to the direction of the first array fibres 5 in order that the first array fibres may run along the return faces 4 in an undisturbed manner towards the thrust transfer surfaces 3. The thrust transfer surfaces 3 lie perpendicularly in the path of the first array fibres and for this reason the high compressive strength available when the fibres are loaded axially is exploited and the anisotropy of the sabot can be used to distribute the thrust more evenly along the penetrator than has hitherto been possible with prior art sabots fabricated from an isotropic mass.

If the angle between the first array fibres and the central channel is too small, too few groove engagements will take place over the length of the sabot, resulting in critically high loads at each thrust transfer surface, and the possibility of the sabot jumping grooves or becoming prematurely stripped from the projectile. To overcome this problem two solutions are available. The first solution is to reduce the angle Z, between the faces 3 and 4 of each groove 10, which reduces the longitudinal extent of each groove slightly and allows more grooves to be fitted in over the length of the sabot. With the sabots described above the angle Z can be reduced as far as 70° by changing the orientation of thrust transfer surfaces 3, before the load transfer capability of the sabot is significantly reduced. The second solution shown in FIG. 4 is to incorporate a second array of fibres 9, which are parallel to the channel 1.

As the principal material direction $P_1$ bisects the angle between the first array fibres 5 and the second array fibres 9, the result on the groove geometry is that for a given principal material direction $P_1$ twice as many grooves 10 are fitted in over the length of the sabot. This is so because the angle Y between the return faces 4 and the central channel 1 is doubled. Added advantages of this arrangement are that the grooves have a greater radial extent, and second array fibres 9 facilitate sculpting of the outer surface of the sabot.

Sabots using a single array of fibres are suitable for the production of saddle back sabots (FIG. 7*b*) and the forward ramps of double ramp sabots (FIG. 7*a*). The incorporation of the second array of fibres 9 introduces the possibility of making the rear ramp 8 integral with the forward ramp of a double ramp sabot (FIG. 7*a*)

Two methods of manufacturing the sabot according to the invention are described below, both methods involve the production of petals 18 with a segment shaped cross-section (see FIGS. 8*a*, 8*c*) by different routes. The final stages of the methods are basically the same and are described once only after the separate descriptions covering the petal production stages.

Method I

Method I involves the use of unidirectional fibre reinforced pultrusions, which are available commercially as a standard product. These pultrusions are formed by drawing aligned fibres through a mould into which a matrix is fed. The fibres embedded in the matrix emerge from the mould through an orifice the shape of which determines the final cross section of the pultrusion.

Pultrusions suitable for this application are reinforced with carbon fibre or glass fibre which are set in a matrix of polyester or epoxy resin.

The pultrusions are then cut into segment shaped petals shown in FIGS. 8*b* and 8*c*. Outer surface 12 of the petal is parallel to the fibres 5 in the pultrusion, and is at an angle X to the inner petal surface 15 (see FIG. 3). The angle between the side faces 16 of the petal is dependent on the number of petals to be used in the fabrication of a single sabot. In the assembly shown in FIG. 8*a*, six petals are used and the angle will thus be 60. A standard carbon fibre reinforced segment shaped pultrusion is available with 11.5° between its side faces, from which thirty petals for a sabot can conveniently be cut.

Method II

This method involves the use of radial laminations (see FIGS. 11 and 12) of unidirectional fibre fabric such as carbon fibre fabric cross stitched with cotton at 22 prepregnated with thermosetting epoxy resin. Two types of laminations are used: (a) those shown in FIG. 11 which contain second array fibres 9 which will eventually be parallel to the penetrator's longitudinal channel 1 and (b) those shown in FIG. 12 which contain fibres 5 which will eventually be orientated at an angle Y to the penetrator's longitudinal axis 2 (see FIG. 4). The laminations shown in FIG. 11 are provided with an extra piece of fibre fabric 24 at their smaller end which is used to machine a bore rider air scoop from as a final stage of sabot production. The two types of lamination are alternately packed in a segment shaped mould similar in form to the petal 18 shown in FIGS. 8*b* and 8*c*.

In order to keep the volume fraction occupied by fibres at larger radii sufficiently high to withstand high gas pressures laminations which are smaller than those shown in FIGS. 11 and 12 will be used, in the larger radius regions of the petal. The locations of these smaller laminations are shown at 25 and 26 in FIG. 10 which is a schematic transverse cross section of a sabot with the radial laminations illustrated. The petal is then stabilised by being heated and cooled, in order to fuse the matrix.

Sabot Assembly

The petals 18 produced by either of the methods described above are now clamped in the configuration shown in FIG. 8*a*, with spacers 19 between the individual petals which act to maintain glue joint gaps 21 between the petals 18. A central channel 1 is then machined with grooves 10, configured as shown in FIG. 3 in the case of the petals from Method I containing first array fibres only, or configured as shown in FIG. 4 in the case of petals from Method II containing first and second array fibres. This may involve machining a series of annular grooves or a continuous screw thread onto the walls of the channel 1. The petals 18 are then reassembled round and clamped in conforming relationship with a penetrator 33 with spacers 19 between each petal (see FIG. 13, showing first array fibres 5 and second array fibres 9 in the upper part of the sectioned sabot). Glue is then fed into the glue joints 21 between the petals and allowed to harden. The outside surface of the sabot is then machined to the desired form 28 which will involve fashioning an air scoop bore rider or preparing a surface onto which an air scoop 32 can be attached, and providing near the rear end of the sabot a groove 34. An obturating seal 30 engaging groove 34 assists in holding the petals together and in minimising blow past. A seal 31 is attached to the rear end of the sabot overlying the joints between the petals.

If the sabot is of the double ramp type, a separate rearwardly facing ramp 8 may be added to the petal assembly. Alternatively the rearwardly facing ramp may be machined from the petal assembly.

The sabot may alternatively be fabricated from a plurality of load bearing wedge shaped petals spaced from one another by a non-loadbearing medium. If this method of construction is used a plate is provided at the rearward end of the sabot for directing the propelling force of a charge onto rearward ends of the wedge shaped petals.

Other forms of sabot which fall within the scope of the claims will be apparent to those skilled in the art.

The invention claimed is:

1. A sabot having a rearward end and a central longitudinal axis which is surrounded by a channel surface which is engageable with a projectile locatable within the channel, the sabot being at least partially made of a material having an anisotropic compressive strength distribution such that, in individual radial planes which radiate outwards from the central longitudinal axis, the sabot's maximum value of compressive strength is oriented in a first principal material direction and the sabot's minimum value of compressive strength is oriented in a second principal material direction, the material being oriented such that within individual radial planes the first principal material direction radiates at least partially outwardly from the central longitudinal axis towards the rearward end of the sabot.

2. A sabot according to claim 1 wherein within a given radial plane the value of compressive Young's modulus in the first principal material direction divided by the shear modulus measured in that plane and taken along the first principal material direction is greater than 3.

3. A sabot according to claim 2 wherein the Young's modulus to shear modulus ratio lies in the range 10 to 100.

4. A sabot as claimed in claim 1 wherein the channel surface is provided with grooves with forwardly facing thrust transfer surfaces for engagement with a projectile and rearwardly facing return faces.

5. A sabot as claimed in claim 1 wherein the material comprises a matrix containing a first array of substantially unidirectional fibres which radiate outwards at an acute angle X to the central longitudinal axis towards the rearward end of the sabot.

6. A sabot according to claim 5 wherein the channel surface is provided with grooves with forwardly facing thrust transfer surfaces for engagement with the projectile and rearwardly facing return faces wherein the thrust transfer surfaces lie substantially perpendicularly in the path of the first array fibres.

7. A sabot having a rearward end and a central longitudinal axis which is surrounded by a channel surface which is engageable with a projectile locatable within the channel, the sabot being made of a material having an anisotropic compressive strength distribution such that in individual radial planes which radiate outwards from the central longitudinal axis the sabot's maximum value of compressive strength is oriented in a first principal material direction and the sabot's minimum value of compressive strength is oriented in a second principal material direction, the material being oriented such that within individual radial planes the first principal material direction radiates from the central longitudinal axis towards the rearward end of the sabot wherein the material comprises a matrix containing a first array of substantially unidirectional fibres which radiate outwards at an acute angle X to the central longitudinal axis towards the rearward end of the sabot wherein the material further comprises a second array of substantially unidirectional fibres which are substantially parallel to the sabot's central longitudinal axis.

8. A sabot according to claim 5 in which the channel surface is provided with grooves with forwardly facing thrust transfer surfaces for engagement with the projectile and rearwardly facing return faces wherein the return faces are disposed at substantially the same acute angle X to the central longitudinal axis as the first array fibres.

9. A sabot according to claim 4 wherein the thrust transfer surface and the return face of a groove meet substantially perpendicularly.

10. A sabot according to claim 4 wherein the thrust transfer surface and the return face of a groove meet at an acute angle of between 70° and 90°.

11. A sabot according to claim 5 wherein the angle X lies in the range 6° to 35°.

12. A sabot according to claim 11 wherein the angle X lies in the range 10° to 25°.

13. A sabot as claimed in claim 1 which also comprises a rearwardly facing ramp.

14. A sabot as claimed in claim 1 comprising a plurality of petals each having a sector shaped cross section perpendicular to the longitudinal axis.

15. A sabot according to claim 5 comprising a plurality of petals each having a sector shaped cross section perpendicular to the longitudinal axis wherein the first array fibres in each individual petal are substantially mutually parallel.

16. A sabot according to claim 1 wherein the sabot comprises radially disposed laminations containing fibres, the fibres in each lamination being substantially mutually parallel.

17. A sabot having a rearward end and a central longitudinal axis surrounded by a channel surface which is engageable with a projectile locatable therein, the sabot at least partially comprising a plurality of longitudinal elements extending outwards on radial planes from the central longitudinal axis, the material of each element having about its plane an anisotropic compressive strength distribution and different principal material directions such that each element has its maximum value of compressive strength in a first principal material direction and its minimum value of compressive strength in a second principal material direction, material in each element being oriented such that the first principal material direction radiates at least partially outwardly from the channel towards the rearward end of the sabot.

18. A sabot having a rearward end and a central longitudinal axis which is surrounded by a channel surface which is engageable with a projectile locatable within the channel, the sabot being at least partially made of a material having an anisotropic compressive strength distribution such that, in individual radial planes which radiate outwards from the central longitudinal axis, the sabot's maximum value of compressive strength is oriented in a first principal material direction and the sabot's minimum value of compressive strength is oriented in a second principal material direction, the material being oriented such that within individual radial planes the first principal material direction radiates at least partially outwardly at an acute angle from the central longitudinal axis towards the rearward end of the sabot, wherein the acute angle lies in the range 6° to 35°.

19. A sabot according to claim 18, wherein the acute angle lies in the range 10° to 25°.

* * * * *